US006152444A

United States Patent [19]

Elgee et al.

[11] Patent Number: 6,152,444

[45] Date of Patent: Nov. 28, 2000

[54] SHUTTLING MEDIA MOVEMENT SYSTEM FOR HARDCOPY DEVICES

[75] Inventors: Steven B. Elgee, Portland, Oreg.; George W. Lewis, Sant Cugat del valles, Spain

[73] Assignee: Hewlett-Packard Company, Palo Alto, Calif.

[21] Appl. No.: 09/428,640

[22] Filed: Oct. 27, 1999

[51] Int. Cl.[7] ..... B65H 5/12

[52] U.S. Cl. ..... 271/266; 271/267; 271/193; 271/194; 271/84

[58] Field of Search ..... 271/266, 267, 271/268, 193, 194, 84; 347/104; 399/388; 400/628

[56] References Cited

U.S. PATENT DOCUMENTS 4,683,481 7/1987 Johnson .
5,276,970 1/1994 Wilcox et al. .
5,278,584 1/1994 Keefe et al. .
5,774,074 6/1998 Cooper et al. .
5,964,568 10/1999 Codatto ..... 271/267 X

FOREIGN PATENT DOCUMENTS 4354742 12/1992 Japan ..... 271/267

*Primary Examiner*—David H. Bollinger
*Attorney, Agent, or Firm*—Flory L. Martin

[57] ABSTRACT

A shuttling media movement system moves media in a hardcopy device, such as an inkjet printing mechanism, a facsimile machine or a multi-function device. The shuttling media movement system has a first member with a first set of fingers for periodically supporting the media, and a second member having a second set of fingers for periodically supporting the media. A motor drive is coupled to the second member to periodically interleave the second set of fingers into and out of engagement with the first set of fingers to move the media with respect to the first member in the interaction zone. Vacuum forces or electrostatic forces are used to periodically grip the media against the sets of fingers. A hardcopy device is provided with such a shuttling media movement system, along with a method for moving media in an interaction zone of a hardcopy device.

20 Claims, 4 Drawing Sheets

SHUTTLING MEDIA MOVEMENT SYSTEM FOR HARDCOPY DEVICES

FIELD OF THE INVENTION

The present invention relates generally to hardcopy devices which advance media through an interaction zone for printing or document scanning, such as electrophotographic copiers or printers, or reciprocating head scanners or inkjet printing mechanisms, including multi-function hardcopy devices having scanning, facsimile and printing capabilities. More particularly, the present invention relates to a shuttling media movement system which positions and advances media through an interaction zone of the hardcopy device.

BACKGROUND OF THE INVENTION

The term "hardcopy device" includes a variety of scanners, printers and plotters, including those using inkjet and electrophotographic technologies to read an image from, or to apply an image to, a hardcopy medium, such as paper, transparencies, fabrics, foils and the like. Inkjet printing mechanisms print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with a full supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multi-color cartridges, several printheads and reservoirs are combined into a single unit, with each reservoir/printhead combination for a given color also being referred to herein as a "pen." As the inkjet industry investigates new printhead designs, one trend is toward using a "snapper" reservoir system where permanent or semi-permanent printheads are used and a reservoir carrying a fresh ink supply is snapped into place on the printhead.

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is propelled through a printzone back and forth across the page, ejecting drops of ink in a desired pattern as it moves. By selectively energizing the resistors as the printhead moves across the page, the ink is expelled in a pattern on the print media to form a desired image (e.g., picture, chart or text). The nozzles are typically arranged in linear arrays usually located side-by-side on the printhead, parallel to one another, and perpendicular to the scanning direction of the printhead, with the length of the nozzle arrays defining a print swath or band. That is, if all the nozzles of one array were continually fired as the printhead made one complete traverse through the printzone, a band or swath of ink would appear on the sheet. The width of this band is known as the "swath height" of the pen, the maximum pattern of ink which can be laid down in a single pass. The print media, such as a sheet of paper, is moved through the printzone typically one swath width at a time, although some print schemes move the media incrementally by, for instance, halves or quarters of a swath width for each printhead pass to obtain a shingled drop placement which enhances the appearance of the final image.

Whether the printing mechanism uses either a snapper cartridge system, an off-axis system, a replaceable cartridge system or some other inkjet system, drop placement on the media must be coordinated with the incremental advance of the media through the printzone for sharp, vivid images and text, which are free of print defects, such as color banding, improper spacing, and printed line overlapping. Many types of inkjet printing mechanisms use a series of conventional paper drive rollers or tires to frictionally engage the print media and incrementally advance the media through the printzone, moving either a full or fractional swath width. To provide feedback to the printer controller regarding the location of the media with respect to the printhead, more recent printers, such as the DeskJet® 720C and 722C models of inkjet printers, manufactured by the present assignee, the Hewlett-Packard Company of Palo Alto, Calif., have incorporated an optical encoder wheel on the axle of the media advance tires. This system required two optical sensors to read the encoder wheel and correct for any eccentricity of the code wheel, as described in U.S. Pat. No. 5,774,074, which is assigned to the present assignee, the Hewlett-Packard Company. It would be desirable to implement a new media advancing and positioning system that increases printing speed and accuracy to provide consumers with a faster printing unit which prints high quality images.

Other hardcopy devices include scanners which have a scanhead with image receptors that "read" an image previously printed on media, and convert this image into an electronic file which may then be computer edited, or sent to a selected destination via either electronic mail (e-mail) or facsimile transmitted over telephone lines, for instance. The image receptors in a scanhead may be a series of discrete elements arranged in a linear array, as described above for an inkjet printhead. These hardcopy scanning mechanisms may use the same media advance system as described above for an inkjet printing mechanism, and indeed, in many multi-function devices the same media advance system is used for both printing and scanning.

As a more general concept, both inkjet printheads and scanheads may be considered as "image transceiver heads," with printheads transceiving an image by printing that image on media, while scanheads transceive an image by "reading" an image that already exists on media. This generic image transceiver head may have one or more arrays of discrete interaction elements arranged, for instance, in a linear array, to selectively interact with media in an interaction zone of the hardcopy device. For a printing mechanism, the interaction elements are ink-ejecting nozzles and the interaction zone is a printzone. For a scanning mechanism, the interaction elements are image receptors and the interaction zone is a readzone, although in some multi-function devices, the printzone and readzone may both physically occupy the same location adjacent the media advance path.

SUMMARY OF THE INVENTION

According to one aspect of the present invention, a shuttling media movement system for moving media in an interaction zone of a hardcopy device having a media interaction head. The shuttling media movement system includes a first member having a first set of fingers for periodically supporting the media, and a second member having a second set of fingers for periodically supporting the media. A motor drive is coupled to the second member to periodically interleave the second set of fingers into and out of engagement with the first set of fingers to move the media with respect to the first member in the interaction zone. In one illustrated embodiment, vacuum forces are used to periodically grip the media against the first and second sets of fingers, whereas in another illustrated embodiment, electrostatic forces are used to accomplish this function.

According to a further aspect of the invention, an inkjet printing mechanism is provided as including a shuttling media movement system as described above.

According to still another aspect of the invention, a method is provided for moving media in an interaction zone of a hardcopy device having a media interaction head. The method includes the steps of gripping an undersurface of the media with a first member, and moving a second member away from the first member. Thereafter, in another gripping step, the undersurface of the media is gripped with the second member, and in a releasing step, the grip of the first member on the media is released. Thereafter, in another moving step, the second member is moved toward the first member to move the media toward the first member.

An overall goal of the present invention is to provide a hardcopy device with a new media advance system for accurately moving media through an interaction zone for printing or scanning, along with a method of performing this new media advance and positioning routine.

Another goal of the present invention is to provide a hardcopy device which reliably produces clear crisp images over its lifetime.

A further goal of the present invention is to provide a hardcopy device which accurately scans images over its lifetime.

A further goal of the present invention is to provide a hardcopy device which positions media laterally in the printzone to control media skew and avoid the print defects associated with printing on a sheet which is traveling through the printzone with lateral margins which are improperly aligned with the lateral edges of the printzone.

Still another goal of the present invention is to provide a hardcopy device with a media movement system which avoids situations where the media may contact the printheads to prolong printhead life.

Yet another goal of the present invention is to provide a hardcopy device with a media movement system which advantageously maintains proper printhead-to-media spacing to yield consistent, high quality images.

A further goal of the present invention is to provide a hardcopy device with a media movement system which only contacts one side of the media in a substantially flat interaction zone to allow the handling of sensitive media where otherwise the use of pinch rollers would leave marks, the handling of thicker media than just conventional plain or treated paper, and the handling of very rigid media, such as poster board.

An additional goal of the present invention is to provide a hardcopy device with a media movement system which uses economical linear encoders to accurately monitor media movement through the printzone, rather than the earlier expensive rotational encoders, to provide consumers with a reliable, robust and economical printing unit.

DETAILED DESCRIPTION OF THE PREFERRED EMBODIMENTS

Figure 1:
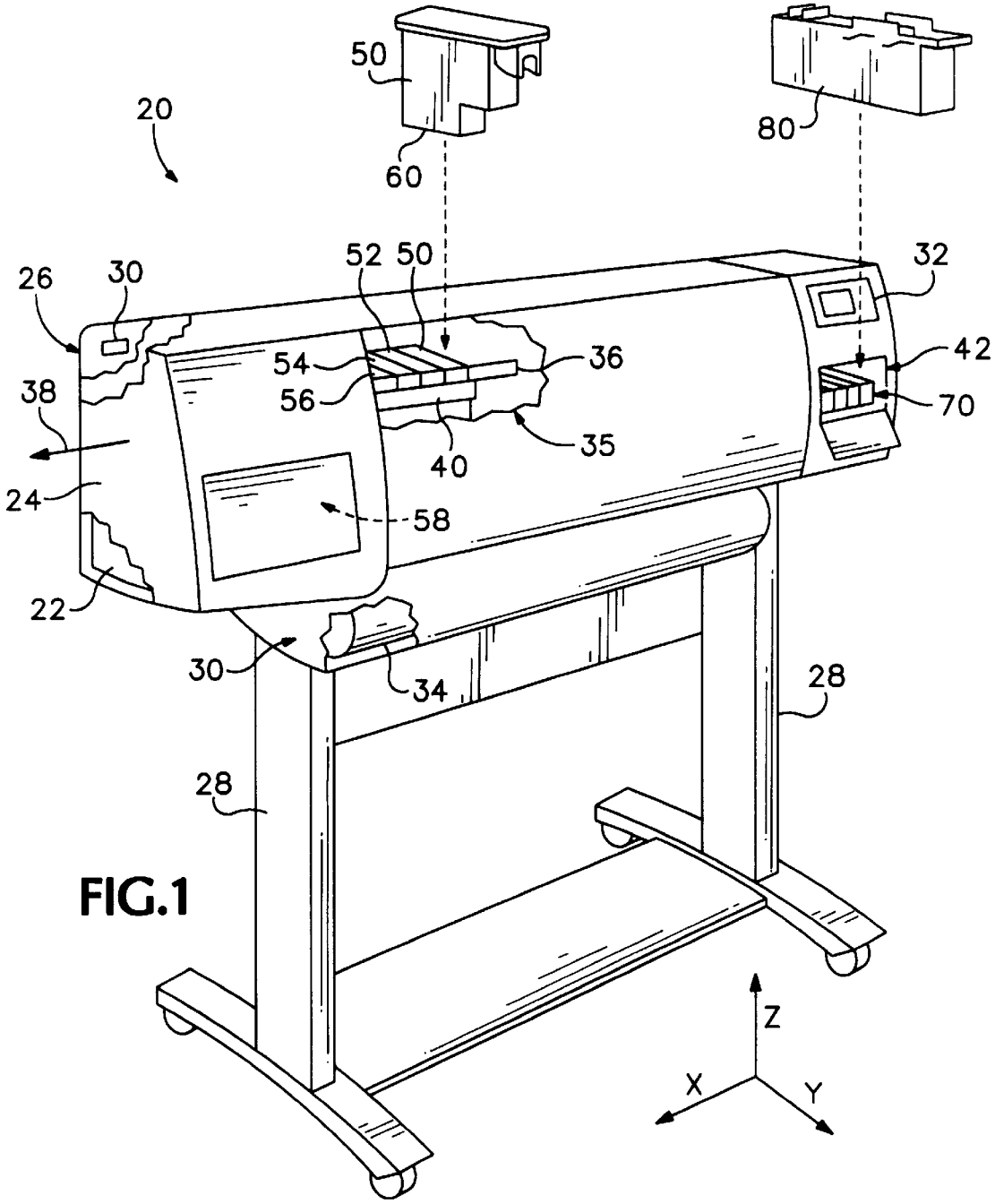
FIG. 1 is a perspective view of one form of a hardcopy device, here an inkjet plotter, including one form of a shuttling media movement system for positioning media in, and advancing media through an interaction zone for scanning or printing.

FIG. 1 illustrates an embodiment of an inkjet printing mechanism, here shown as an inkjet plotter 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material, together forming a print assembly portion 26 of the plotter 20. While it is apparent that the print assembly portion 26 may be supported by a desk or tabletop, it is preferred to support the print assembly portion 26 with a pair of leg assemblies 28. The plotter 20 also has a plotter controller, illustrated schematically as a microprocessor 30, that receives instructions from a host device, typically a computer, such as a personal computer or a computer aided drafting (CAD) computer system (not shown). The plotter controller 30 may also operate in response to user inputs provided through a key pad and status display portion 32, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in DesignJet® 650C and 750C color plotters, produced by Hewlett-Packard Company, of Palo Alto, Calif., the present assignee. Of course, sheet severing may be accomplished in a variety of other ways known to those skilled in the art. Moreover, the illustrated inkjet printing mechanism may also be used for printing images on pre-cut sheets, rather than on media supplied in a roll 34.

Figure 2:
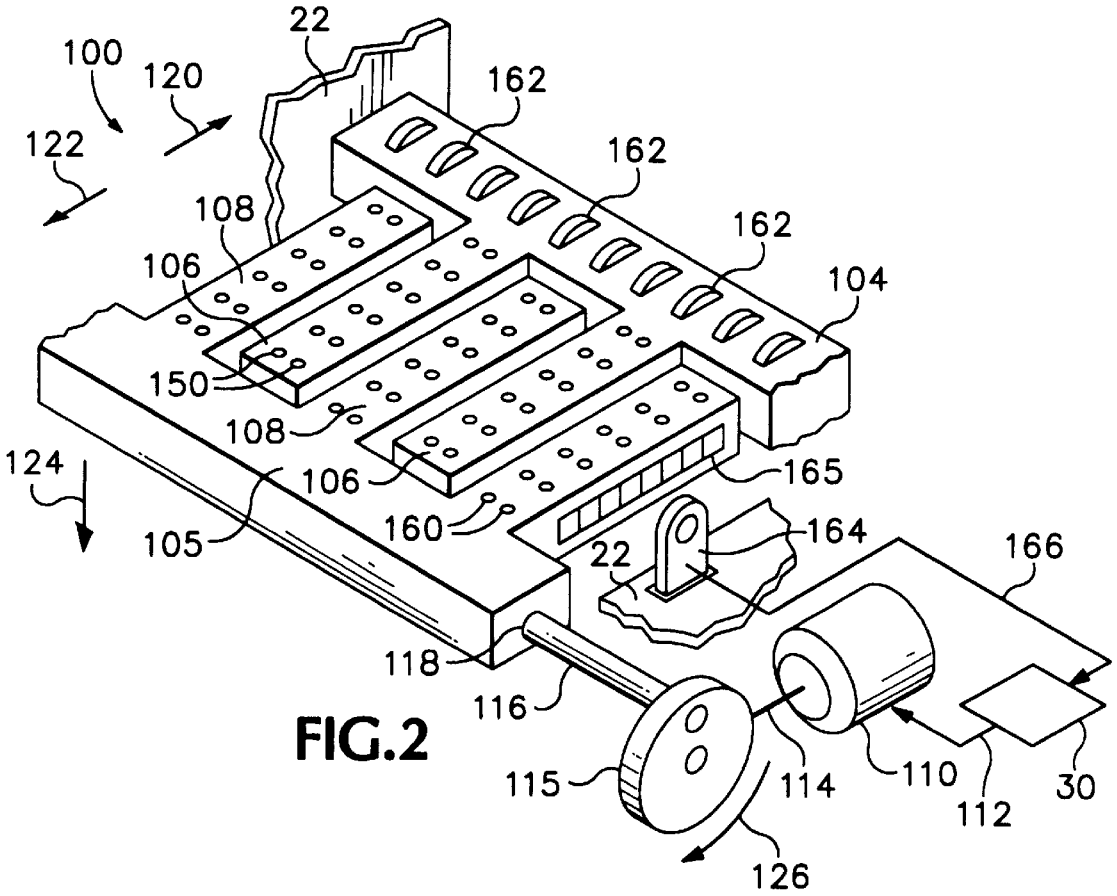
FIG. 2 is an enlarged perspective view of the shuttling media movement system and positioning system of FIG. 1.

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics. The illustrated plotter 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 each have a printhead, such as printhead 60 for the black pen 50, which selectively eject ink to from an image on a sheet of media 34 in the printzone 35. The illustrated inkjet printheads have a large print swath, for instance about 20 to 25 millimeters (about one inch) wide or wider, although the printhead maintenance concepts described herein may also be applied to smaller inkjet printheads. The concepts disclosed herein for maintaining and operating these printheads apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads, such as printhead 60, each have an orifice plate with a plurality of nozzles formed therethrough in a manner well known to those skilled in the art. The nozzles of each printhead are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. The illustrated printheads are thermal inkjet printheads, although other types of printheads may be used, such as piezoelectric printheads. The thermal printheads typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

To clean and protect the printheads, a "service station" mechanism 70 is typically mounted within the servicing region 42 plotter chassis 22 so the printheads can be moved over the station for maintenance. The service station 70 uses four replaceable inkjet printhead cleaner units, such as a black cleaner unit 80, used to service the black printhead 60. Each of the cleaner units has an installation and removal handle, which may be gripped by an operator when installing the cleaner units. Following removal, the cleaning units are typically disposed of and replaced with a fresh unit, so the units may also be referred to as "disposable cleaning units," although it may be preferable to return the spent units to a recycling center for refurbishing.

For storage, or during non-printing periods, the cleaning units each have a capping system which hermetically seals the printhead nozzles from contaminants and drying. Some caps are also designed to facilitate priming, such as by being connected to a pumping unit or other mechanism that draws a vacuum on the printhead. During operation, clogs in the printheads are periodically cleared by firing a number of drops of ink through each of the nozzles in a process known as "spitting," with the waste ink being collected in a "spittoon" reservoir portion of the service station.

After spitting, uncapping, or occasionally during printing, most service stations have an elastomeric wiper that wipes the printhead surface to remove ink residue, as well as any paper dust or other debris that has collected on the face of the printhead. Other service stations include auxiliary wiping members to clean areas of the pen adjacent to the ink ejecting nozzles. For instance, a pair of "mud flaps" in the models 720C and 722C DeskJet® color inkjet printers wipe regions beside the color nozzles, while a "snout wiper" in the models 2000 and 2500 DesignJet® color inkjet plotters wipe a rear vertical surface underneath an electrical interconnect region of the pen, with these printers and plotters both being sold by the present assignee, the Hewlett-Packard Company of Palo Alto, Calif.

Figure 3:
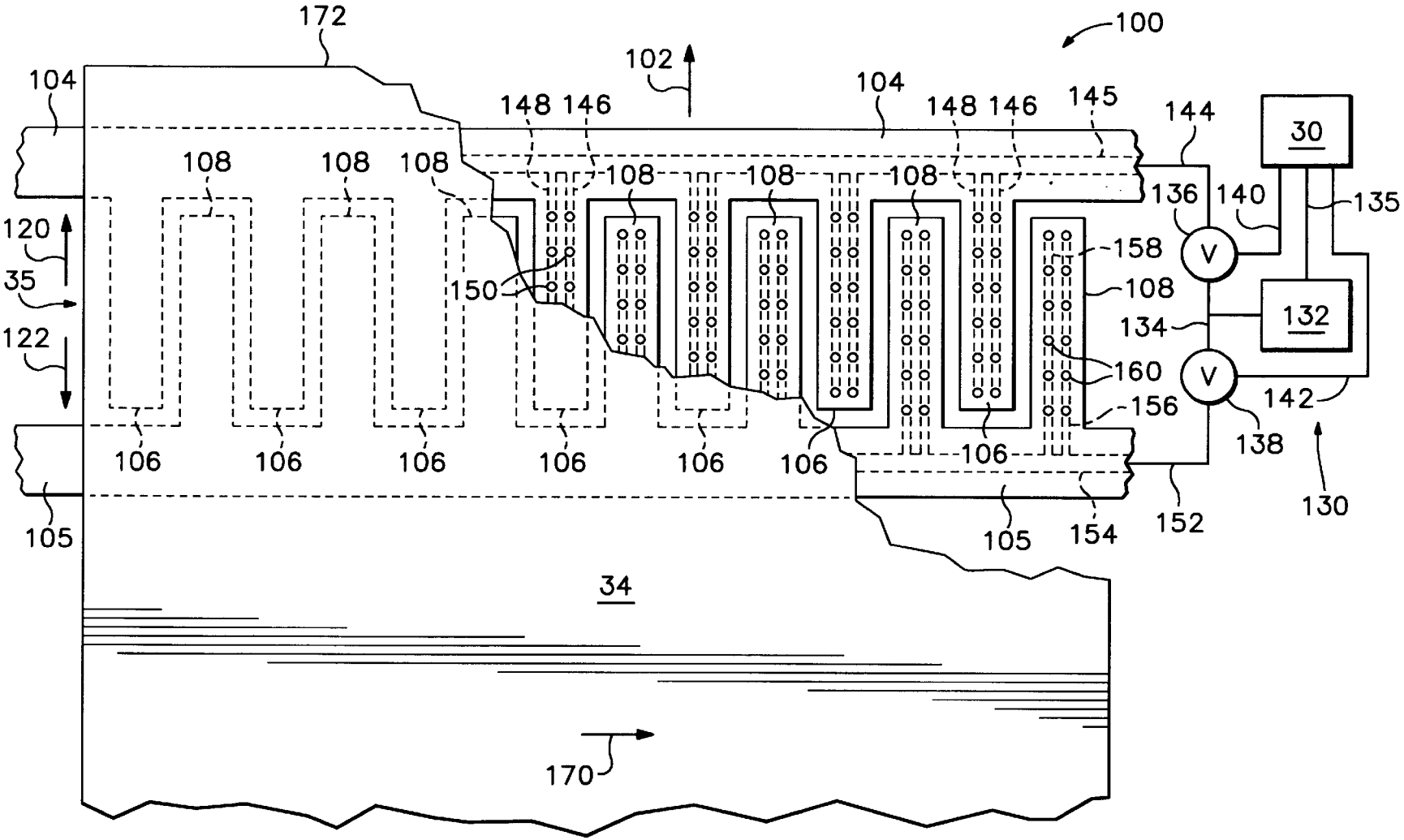
FIG. 3 is an enlarged top plan view of the shuttling media movement system of FIG. 1, shown beginning to move a sheet of media through the interaction zone.

FIGS. 2 and 3 illustrate one form of a shuttling media movement system 100 constructed in accordance with the present invention, for moving a sheet of media 34 through the interaction zone 35 in the direction of arrow 102. The shuttling media movement system 100 has a fixed or passive media movement member or arm 104 supported by the chassis 22, and an active media movement member or arm 105. The passive arm 104 has a series of fingers or support tongs 106 which are interleaved with a series of fingers or support tongs 108 extending from the active arm 105. The active arm 105 moves to totally or partially engage and disengage the fingers 106 and 108 in response to operation of a motor 110, while the media 34 is temporarily attached to the fingers 106 then to fingers 108 by a gripping means or mechanism, such as one employing vacuum forces or electrostatic forces.

The motor 110 operates in response to a control signal 112 which is received from the plotter controller 30. The motor 110 has an output shaft 114 which is coupled to drive an eccentric member 115. A drive link or lever 116 extends from the eccentric 115 for pivotal attachment to a pivot post 118 on the active arm 105. Rotation of motor 110 serves to move the fingers 106 and 108 into engagement by moving arm 105 in the direction of arrow 120, and totally or partially out of engagement by moving arm 105 in the direction of arrow 122. When retreating or moving out of engagement in the direction of arrow 122, the arm 105 is preferably moved downwardly in the direction of arrow 124 as the eccentric 115 rotates in the direction of arrow 126 from the initial position shown in FIG. 2. There are a variety of other ways that the active arm 105 may be moved to engage and disengage the fingers 106 and 108, as known to those skilled in the art. For instance, belt drives, ratcheting mechanisms, chain link assemblies, cam systems, etc. may be substituted for the eccentric 115 and lever 116 drive assembly. Moreover, rather than having one fixed arm and one active arm, both arms 104 and 105 may be moved into engagement and out of engagement if desired in some implementations.

FIG.3 illustrates one form of a vacuum media hold down system 130 used to hold a sheet of media 34 against the interleaving fingers 106 and 108 of arms 104 and 105, respectively. A vacuum source 132 draws vacuum pressure through a manifold 134 in response to a control signal 135 received from the controller 30. The manifold 134 terminates in a pair of valves 136 and 138, which are selectively opened and closed in response to control signals 140 and 142, respectively, received from the controller 30. When the valve 136 is open, vacuum pressure is drawn by the source 132 through manifold 134, then through a coupling 144 which joins a fixed arm manifold 145. The fixed arm manifold 145 draws vacuum pressure through at least one, but preferably through two vacuum lines 146 and 148, which extend through each of the fingers 106 of the fixed arm 104. A series of inlet ports or apertures 150 couple the finger vacuum lines 146 and 148 to atmosphere at a location under the interaction zone 35. When a sheet of media 34 is being transported through the interaction zone 35, the vacuum provided by source 132 serves to pull the sheet 34 into contact with the fixed fingers 106.

Similarly, when valve 138 is open, a vacuum is drawn by source 132 through the manifold 134. The valve 138 joins the manifold 134 to a flexible coupling member 152, which is coupled to an active arm manifold 154. The active arm manifold 154 provides a vacuum force to at least one, but preferably to two or more vacuum lines 156 and 158, which extend through each of the active arm fingers 108. The vacuum lines 156, 158 are coupled to atmosphere through a series of apertures or inlet ports 160 which extend through the fingers 108. When a sheet of media 34 is being transported through the interaction 35, the vacuum provided by source 132 serves to pull the sheet 34 into contact with the active fingers 108 when valve 138 is open.

Figure 4:
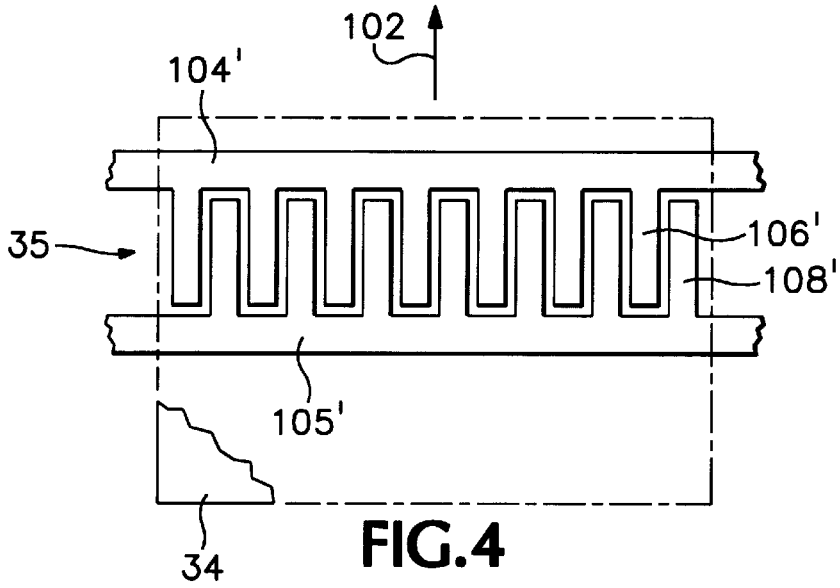
FIGS. 4–6 are enlarged top plan views of an alternate embodiment of the shuttling media movement system of FIG. 1, showing the operation of moving a sheet of media through the interaction zone, with FIG. 4 showing a first step, FIG. 5 showing a second step, and FIG. 6 showing a third step.
Figure 5:
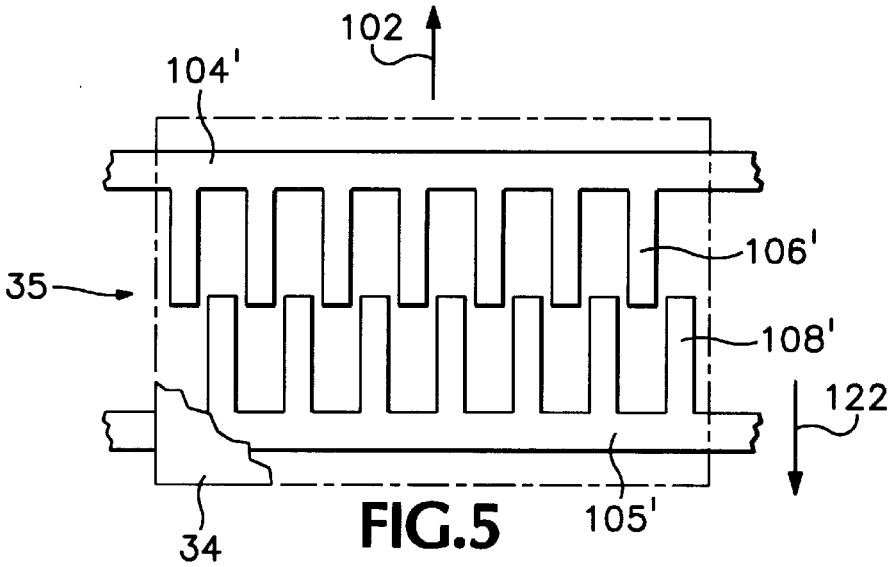
Figure 6:
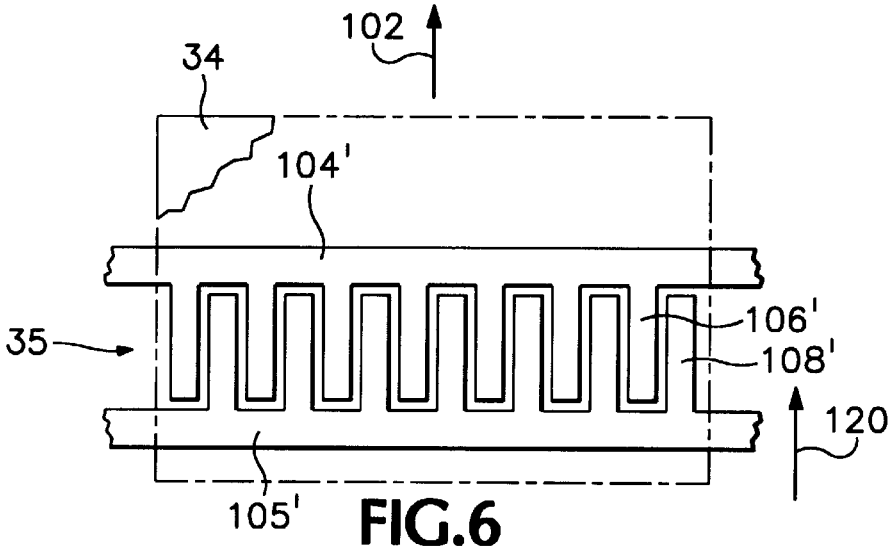

FIGS. 4–6 illustrate one form of a second embodiment of a shuttling media movement system 100' constructed in accordance with the present invention, for moving a sheet of media 34 through the interaction zone 35 in the direction of arrow 102. The shuttling media movement system 100' has a passive or fixed media movement member or arm 104' supported by the chassis 22, and an active media movement member or arm 105'The fixed arm 104' has a series of fingers or support tongs 106' which are interleaved with a series of fingers or support tongs 108' extending from the active arm 105'The active arm 105' may be coupled to motor 110 in the same manner as described above for the vacuum hold-down system 100 to engage and disengage the fingers 106' and 108'. Rather than using a vacuum system 130 to hold the media against the fingers 106' and 108', this alternate system 100' uses electrostatic forces to pull the media into contact with the fingers 106' and 108'.

These electrostatic forces for system 100' may be generated by making the arms 104', 105' and fingers 106', 108' from electrically conductive materials. The control system of FIG. 3 may be used to understand how such an electrostatic may be implemented. The electrostatic control system may be constructed by replacing the vacuum source 132 with a voltage source, and the valves 136 and 138 with electrical switches, all of which may operate in response to control signals 135, 140 and 142 received from controller 30. The vacuum lines 144, 146, 148, 152, 156 and 158 may be replaced with electrical conductors, and the inlet ports 105, 160 may be eliminated. The manifolds 145 and 154 may be replaced with electrical buses or other conductors. Indeed, the electrostatic shuttling media movement system 100' may have the advantage of being quieter to operate, as well as easier to power and control, than the vacuum shuttling media movement system 100. Electrostatic beds for gripping media in a static, non-moving, condition are used in other systems, such as for an accessory to a spectrophotometer instrument, which reads the colors previously printed on paper. One such electrostatic bed used to hold media in a fixed location for a spectrophotometer to analyze is sold under the trademark of SpectroScan® by Gretag Macbeth of Regensdorf, Switzerland.

FIGS. 4–6 also serve to illustrate the manner in which the fingers 106, 106" and 108, 108' engage and disengage to move the media sheet 34 through the interaction zone 35 in the direction of arrow 102. In FIG. 4, shows a first step where the fingers are totally interleaved. Rotation of the eccentric 115 by motor 110 (see FIG. 2) causes the active arm 105' to retreat away from the fixed arm 104' in the direction of arrow 122 until the position of FIG. 5 is reached. Optionally, rotation of the eccentric 115 may cause the active arm 105' to move downwardly in the direction of arrow 124 also at the same time while pursuing this retreating motion in the direction of arrow 122. At the FIG. 5 position, preferably the active arm 105, 105' is at the same elevation as the passive arm 104, 104' to rest under the media sheet 34. In some implementations it my be preferred to have the active arm 105, 105' move slightly above the elevation of the passive arm 104, 104' to assist in breaking the frictional and vacuum forces holding the sheet 34 in contact with the passive arm 105, 105'. While the length of this retreating stroke during the transition from FIG. 4 to FIG. 5 is shown to almost completely disengage fingers 106' and 108', it is apparent that fractional steps or strokes may be made, perhaps with some adjustment to the shape of eccentric 115. Advancing the media sheet 34 a fraction of a swath height would be of particular interest when printing with shingling print modes, as discussed in the Background section above, where the media is advanced only a fraction of the entire length of the linear array of nozzles on the printheads of the pens 50–56.

During the retreating motion of the active arm 105 in the vacuum hold down system 100, valve 136 is open to apply vacuum force through ports 150 to hold the media sheet 34 in place against the fixed fingers 106. Also during this retreating stroke, valve 138 is closed to remove vacuum force from the fingers 108 to allow the active arm 105 to freely move away from the sheet 34 at the initiation of the retreating stroke. In the position of FIG. 5 a transition occurs in the vacuum system 130. At this point in response to signal 142, the active arm valve 138 opens to apply vacuum through coupling 152, manifold 154, and finger lines 156, 158 to the inlet ports 160. This application of vacuum force to the inlet ports 160 serves to draw the media sheet 34 against fingers 108 of the active arm 105. Also at this FIG. 5 transition position in response to signal 140, the fixed arm valve 136 closes to remove vacuum force from the passive arm fingers 106. The electrostatic system 100' of FIGS. 4–6 conducts a similar transition in the FIG. 5 position to transfer the electrostatic forces from gripping the sheet 34 against the passive fingers 108' to drawing the sheet 34 into contact with the fingers 108' of the active arm 105'

From the position of FIG. 5, the active arm 105, 105' advances forward in the direction of arrow 120 to bring the active fingers 108, 108' back into engagement with the fingers 106, 106' of the passive arm 104, 104'. This forward motion of the active arm 105, 105' while gripping the media sheet 34 advances the media in direction 102 through the interaction zone 35 to the position shown in FIG. 6. In the FIG. 6 position, the media sheet is ready for a fresh printing or scanning stroke. In this manner, through repeated iterations of the shuttling strokes of FIGS. 4 through 6. a sheet of media 34 is advanced through the interaction zone 35 for printing or scanning. After applying ink to print an image on the sheet 34 the sheet may become saturated with ink. To aid in supporting the saturated sheet as it exits the interaction zone 35, the passive arm 104 or 104' may have a series of cockle ribs 162 which allow the wet media to expand into the regions between the ribs while drying, as described in U.S. Pat. No. 5,393,151, currently assigned to the Hewlett-Packard Company, the present assignee.

Referring back to FIG. 2, to provide feedback to the controller 30 as to the position of the active arm 105 or 105', a linear encoder may be used. For instance, an optical encoder 164 may be supported by the chassis 22 in a position to read a linear encoder member 165, which may be mounted along one of the active fingers 106 or 106'. The optical encoder reader 164 sends a positional feedback signal 166 to the plotter controller 30 to indicate how far the media sheet 34 has been advanced through the interactions zone 35. The controller 30 then uses this positional feed back information to determine further media advance steps performed by operating the motor 110, and the vacuum system 130 or the electrostatic system of FIGS. 4–6.

Thus far, the media movement systems 100 and 100' have been described in terms of a advancing media 34 through the interaction zone 35 in the direction of arrow 102. An alternate use for the media movement systems 100, 100' that may be particular beneficial when dealing with certain types of hardcopy devices, such as large-scale plotters 20, assists in aligning the media laterally in the interaction zone 35. For example, referring to FIG. 3, picture the media as advancing to the right in the direction of arrow 170, then the media movement system 100, 100' is positioned under a lateral edge 172 of the media sheet 34. Using the same steps of FIGS. 4–6, the media is moved laterally in the direction of arrows 120 or 122 to properly position the edge of the media 172 as it moves through the interaction zone 35. Indeed, in such a system having lateral edge placement and adjustment using system 100 or 100', the main drive force to move the media sheet 34 through the interaction zone 35 in the direction of arrow 170 may be supplied by a conventional drive roller system, as well as by one of the shuttling systems 100 100'. Thus, composite media movement systems having both main drive rollers and shuttling movement systems may be easily implemented.

Conclusion

Thus, a variety of advantages are realized by using the shuttling media movement system 100 or 100'. One advantage of the shuttling media movement system 100 or 100' is the ability to laterally position the media edges 172 in the interaction zone 35, as discussed with respect to FIG. 3. The shuttling media movement system 100 or 100' may advantageously be used for lateral edge adjustment in conjunction with a conventional roller system for advancing the media through the interaction zone 35, or with a main shuttling media advancement system 100, 100'. It is apparent that other modifications may be made while implementing the concepts illustrated herein. For instance, the active arm 105, 105' may be driven at each end by adding another motor 110 to the system illustrated in FIG. 2. Furthermore, the shuttling media movement system 100 or 100' may be used with a fixed printhead or a fixed scanhead, such as in a page wide array having head which extends across the entire interaction zone 35, instead of reciprocating leads, such as printheads 50–56. In a further adaptation of the shuttling media movement system 100 or 100', this system may be added as of a post-printzone media tensioning system to pull on the media to extract it from the printzone, such as beyond the anti-cockle ribs 162 (FIG. 2), even if the primary media advancement system is a conventional drive roller system, rather than the illustrated shuttling systems.

Further advantages of the shuttling media movement system 100 or 100' stem from the facts that this media movement system only contacts one side of the media 34 and that during printing, the media is in a substantially flat interaction zone 35. Thus, the media movement system 100, 100' facilitates the handling of sensitive media, where otherwise the use of pinch rollers in the earlier hardcopy devices would leave marks. Additionally, the media movement system 100, 100' also facilitates the handling of thicker media than just conventional plain or treated paper, and indeed, even the handling of very rigid media, such as poster board.

In the illustrate embodiments, the interaction zone 35 is shown as extending over the interleaved fingers 106, 106' and 108, 108', although it is apparent that in some implementations it may be preferable to locate the interaction zone in the media advancement path either before or after the shuttling media movement system 100, 100'. One advantage of having the interaction zone 35 over the interleaved fingers 106, 108 or 106', 108' is that the sheet 34 may be actively and firmly pulled against the upper surface of the fingers, through the electrostatic forces of system 100' of by applying vacuum force to both sets of inlet ports 150 and 160 when printing. Holding the sheet of media 34 against the interleaved fingers 106, 108 or 106', 108' when printing prevents the media sheet 34 from floating upwardly to contact the printheads of pens 50–56, so printhead damage is advantageously avoided. Furthermore, tightly holding the sheet of media 34 against the interleaved fingers 106, 108 or 106', 108' when printing also serves to maintain the critical pen-to-paper spacing (PPS) at a controlled distance to improve print quality.

Furthermore, both systems 100, 100' accurately advance a media sheet 34 through a printzone for printing or through a scan zone for scanning. Use of a linear encoder 164, 165 for providing positional feedback information to the controller 30 provides a more accurate and economical feedback system than some of the circular encoders used in conventional drive roller systems. Circular encoders are subject to run-out errors from either the drive rollers or the encoders being slightly out of round or not concentrically mounted. These defects of the circular encoders need extra readers to be compensated for, consuming valuable computing time in the plotter controller 30, and if left unattended, they cause print defects. Use of the linear encoder 164, 165 advantageously avoids these difficulties to provide high quality images. Moreover, the linear encoder 164, 165 is a more economical component, leading to a more economical printing unit for consumers.

We claim:

1. A shuttling media movement system for moving media in an interaction zone of a hardcopy device having a media interaction head, comprising:

a first member having a first set of fingers for periodically supporting the media;

a second member having a second set of fingers for periodically supporting the media; and a motor drive coupled to the second member to periodically interleave the second set of fingers into and out of engagement with the first set of fingers to move the media with respect to the first member in the interaction zone.

2. A shuttling media movement system according to claim 1 wherein the first member and the second member are located in the interaction zone.

3. A shuttling media movement system according to claim 1 wherein the motor drive further includes a motor having an output shaft, an eccentric member driven by the output shaft, and a link member coupling the eccentric member to the second member.

4. A shuttling media movement system according to claim 1 wherein electrostatic forces are used to periodically pull the media into contact with the first set of fingers and to periodically pull the media into contact with the second set of fingers.

5. A shuttling media movement system according to claim 1 wherein vacuum forces are used to periodically pull the media into contact with the first set of fingers and to periodically pull the media into contact with the second set of fingers.

6. A shuttling media movement system according to claim 1 further including a vacuum system comprising:

a vacuum source;

a supply manifold coupled the vacuum source;

a first vacuum passageway defined by the first member;

a first set of plural inlet ports defined by the first set of fingers, with each finger of the first set defining an auxiliary vacuum passageway coupling the inlet ports defined thereby to the first vacuum passageway;

a first valve which selectively couples the supply manifold to the first vacuum passageway;

a second vacuum passageway defined by the second member;

a second set of plural inlet ports defined by the second set of fingers, with each finger of the second set defining an auxiliary vacuum passageway coupling the inlet ports defined thereby to the second vacuum passageway;

a second valve which selectively couples the supply manifold to the second vacuum passageway.

7. A shuttling media movement system according to claim 6 further including a first coupling member which joins the first valve to the first vacuum passageway, and a second coupling member which joins the second valve to the second vacuum passageway.

8. A shuttling media movement system according to claim 7 wherein the second coupling member comprises a flexible member.

9. A shuttling media movement system according to claim 1 further including a linear encoder system which monitors the movement of the second member.

10. A shuttling media movement system according to claim 1 with the interaction zone having a media entrance and a media exit, wherein the first member cooperates with the second member to move the media from the media entrance toward the media exit.

11. A shuttling media movement system according to claim 1 with the interaction zone having a media entrance, a media exit and a pair of opposing lateral sides, wherein the first member cooperates with the second member to move the media between the pair of opposing lateral sides.

12. A shuttling media movement system according to claim 1 with the hardcopy device having a chassis, wherein the first member is stationarily supported by the chassis.

13. A shuttling media movement system according to claim 1 with the interaction zone having a media entrance and a media exit, wherein the first member is located toward the media exit and the second member is located toward the media entrance, and wherein the second member has plural cockle ribs projecting therefrom to support the media upon exiting the interaction zone.

14. A method of moving media in an interaction zone of a hardcopy device having a media interaction head, comprising the steps of:

gripping an undersurface of the media with a first member;

moving a second member away from the first member;

thereafter, gripping the undersurface of the media with the second member and releasing the grip of the first member on the media; and thereafter, moving the second member toward the first member to move the media toward the first member.

15. A method according to claim 14 further including the step of, following the step of moving the second member toward the first member, pausing motion of the first member while a reciprocating head passes over an upper surface of the media in the interaction zone.

16. A method according to claim 14 further including the step of, following the step of moving the second member toward the first member, again gripping the undersurface of the media with a first member.

17. A method according to claim 14 wherein the steps of gripping the undersurface of the media with the first member and the second member comprises gripping with a vacuum force.

18. A method according to claim 14 wherein the steps of gripping the undersurface of the media with the first member and the second member comprises gripping with an electrostatic force.

19. A method according to claim 14 further including the steps of:

providing the first member with a first set of fingers having a surface for gripping the undersurface of the media; and providing the second member with a second set of fingers having a surface for gripping the undersurface of the media, with the first set of fingers being engageable and disengageable with the second set of fingers.

20. A method according to claim 19 wherein:

the step of moving the second member away from the first member comprises disengaging the second set of fingers from the first set of fingers; and the step of moving the second member toward the first member comprises engaging the second set of fingers with the first set of fingers.

* * * * *